US007094099B2

(12) United States Patent
Daggett et al.

(10) Patent No.: US 7,094,099 B2
(45) Date of Patent: Aug. 22, 2006

(54) POSITIVE LOCK PIECE AND ELECTRICAL CONNECTOR ASSEMBLY EQUIPPED WITH SAME

(75) Inventors: Barry M. Daggett, Austintown, OH (US); Raymond J. Blasko, Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/978,660

(22) Filed: Nov. 1, 2004

(65) Prior Publication Data

US 2006/0094293 A1 May 4, 2006

(51) Int. Cl.
*H01R 13/60* (2006.01)
*H01R 13/66* (2006.01)

(52) U.S. Cl. ..... 439/567; 439/544; 439/557

(58) Field of Classification Search ..... 439/544–550, 439/552–553, 555–557, 559–563, 567, 569
See application file for complete search history.

(56) References Cited

U.S. PATENT DOCUMENTS

| | | | | |
|---|---|---|---|---|
| 5,263,871 | A * | 11/1993 | Sano | 439/157 |
| 5,613,876 | A * | 3/1997 | Sakatani et al. | 439/552 |
| 5,836,787 | A * | 11/1998 | Kodama | 439/567 |
| 5,895,289 | A * | 4/1999 | Smith | 439/553 |
| 6,257,930 | B1 | 7/2001 | Yu | 439/607 |
| 6,491,541 | B1 | 12/2002 | Wakino | 439/451 |

* cited by examiner

*Primary Examiner*—Michael C. Zarroli
(74) *Attorney, Agent, or Firm*—David P. Wood

(57) ABSTRACT

An electrical connector assembly comprises an electrical USB connector that has a separate lock piece attached to the terminal of the electrical connector. The lock piece has a collar that fits onto the terminal adjacent to the connector body of the electrical connector. The collar has orientation slots that receive tabs of terminal to properly orient the positive lock piece onto the terminal and inner retention shoulders that cooperate with lock fingers of the terminal for locking the positive lock onto the terminal. A flange attached to the collar serves as a finger guard and push surface when the collar is attached to the terminal. The lock piece has lock arms for attaching the collar to a face panel.

14 Claims, 3 Drawing Sheets

POSITIVE LOCK PIECE AND ELECTRICAL CONNECTOR ASSEMBLY EQUIPPED WITH SAME

FIELD OF THE INVENTION

This invention relates generally to an electrical connector and more particularly to a positive lock piece and an electrical connector assembly equipped with the positive lock piece, particularly an electrical connector assembly that includes a USB connector.

BACKGROUND OF THE INVENTION

With the proliferation of consumer electronics hardware in vehicle applications, the need to incorporate existing non-automotive connection systems, such as USB connectors, is required. Since these standard, consumer electronics connection systems are not designed for the automotive environment and usage, they lack certain desireably attributes.

For the standard USB connection, the lack of a positive connector lock is a deficiency. See for instance U.S. Pat. No. 6,491,541 granted to Jun Wakino Dec. 10, 2002 for a USB cable fixture for preventing a USB connector from being unplugged. The lack of a positive lock in a USB connection is a particularly serious deficiency in automotive applications because the USB connectors can not be plugged in reliably in a vehicle assembly plant and can not be reliably expected to remain fully mated in operation due to vehicle vibration and shock.

A complete re-design of the USB connection interface for automotive usage is not feasible due to the expense involved and the desire to maintain the connection as close to the existing standard as possible. Consequently there is a need to provide a positive lock that can be used in a USB connection system that is easy, inexpensive and requires little if any modification of the standard USB connection system to make the USB connection system acceptable for automotive usage.

SUMMARY OF THE INVENTION

This invention provides an easy and inexpensive positive lock piece for an electrical connector assembly that requires little modification to a standard electrical USB connector when used in a typical USB connection system.

The positive lock piece preferably comprises a single, loose piece, molded plastic part that is easily and conveniently attached to an electrical connector or an easily modified standard USB connector for shipment and handling. The positive lock piece merely requires inexpensive modifications to the terminal of the standard USB connector which permit the positive lock piece to be mounted and retained on the USB connector. The positive lock piece carried by the USB connector then snap locks onto a face plate to retain the terminals of the connection system in full mated engagement with a USB connector that is behind the face plate.

DETAILED DESCRIPTION OF PREFERRED EMBODIMENT

Figure 1:
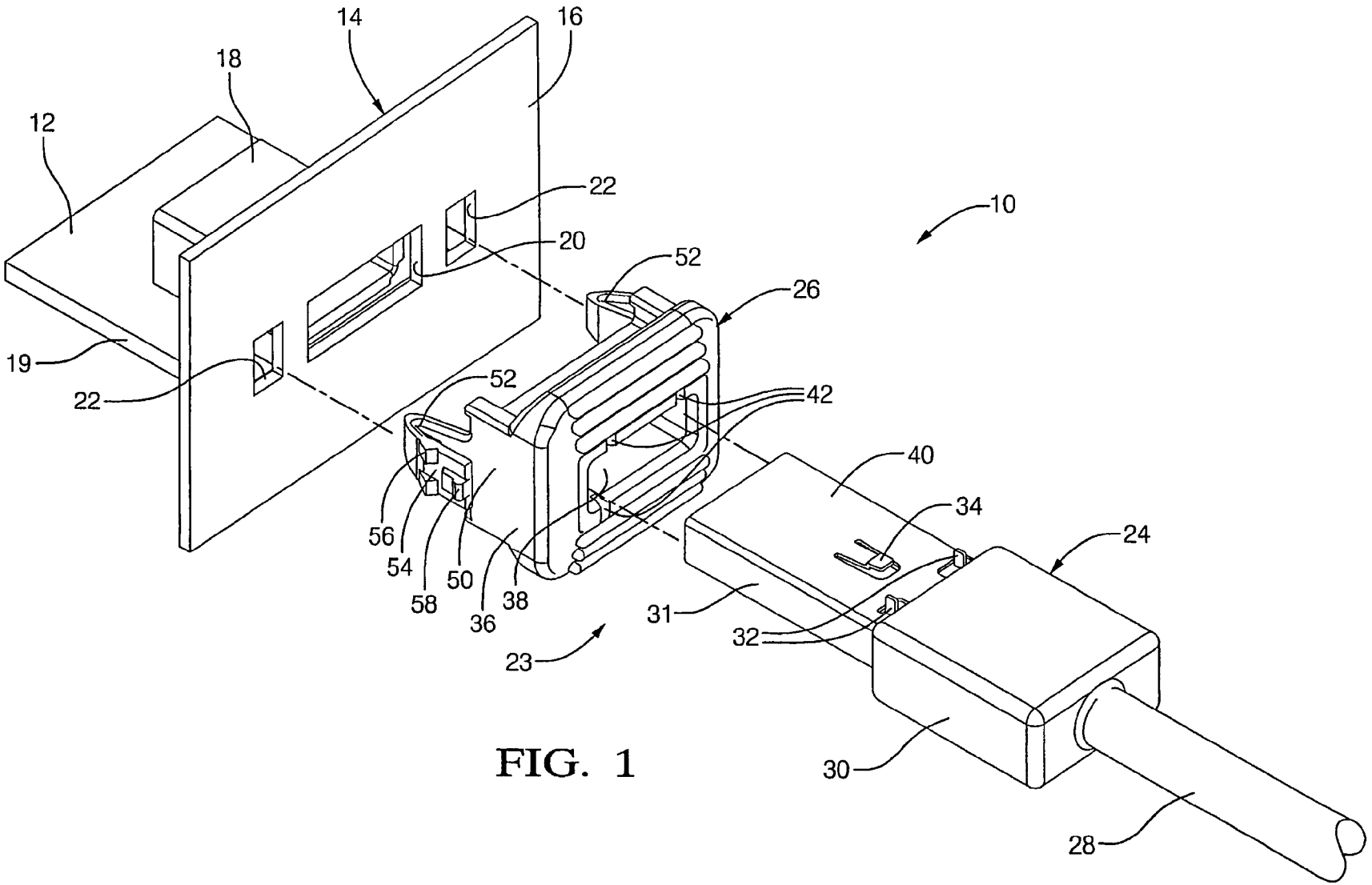
FIG. 1 is an exploded perspective view of an electrical connection system having an electrical connector assembly equipped with a positive lock piece in accordance with the invention.
Figure 2:
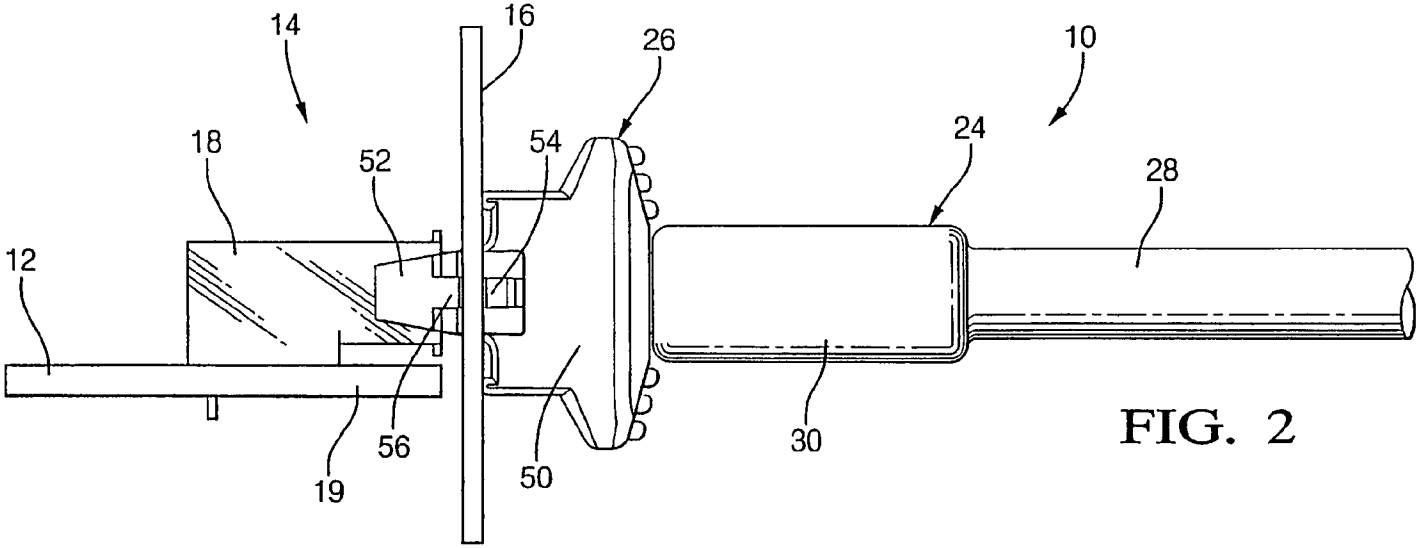
FIG. 2 is a side view of the electrical connection system shown in FIG. 1.

Referring now to the drawing, FIG. 1 is an exploded perspective view of an electrical connection system having an electrical connector assembly equipped with a positive lock piece of the invention. More particularly, the electrical connection system 10 comprises an electronic component 12 that is disposed in a housing 14 having a face panel 16. Electronic component 12 has a standard USB socket connector 18 disposed behind an opening 20 in face panel 16. The standard USB socket connector 18 is in the form of a header connector that is attached to a printed circuit board 19 or the like of the electronic component 12, which for instance may be a radio in an automotive passenger compartment. Face panel 16 preferably also has attachment openings 22 on either side of access opening 20.

Electrical connection system 10 further includes an electrical connector assembly 23 comprising a USB plug connector 24 that is equipped with a positive lock piece that is shown generally at 26. USB plug connector 24 is attached to an electrical cable 28 and comprises a molded plastic connector body 30 and an electrical female terminal 31 having an attachment portion (not shown) that is embedded in connector body 30 and attached to the conductive core of cable 28. Electrical terminal 31 mates with an electrical male terminal (not shown) in socket connector 18. The mating electrical USB connectors are well known standardized designs (except as noted below). See for instance, U.S. Pat. No. 6,257,930 B1 granted to Wei-Ting Yu Jul. 10, 2001.

Female terminal 31 is a modified form of a conventional rectangularly shaped USB female terminal in that the female terminal 31 includes three upstanding orientation tabs 32 (two on top and one on the bottom) and flexible retention fingers 34 on the top and the bottom that cooperate with the positive lock piece 26. The orientation tabs 32 and retention fingers 34 are easily and inexpensively fabricated by punching and bending portions of the sheet metal terminal 31 during manufacture.

Figure 3:
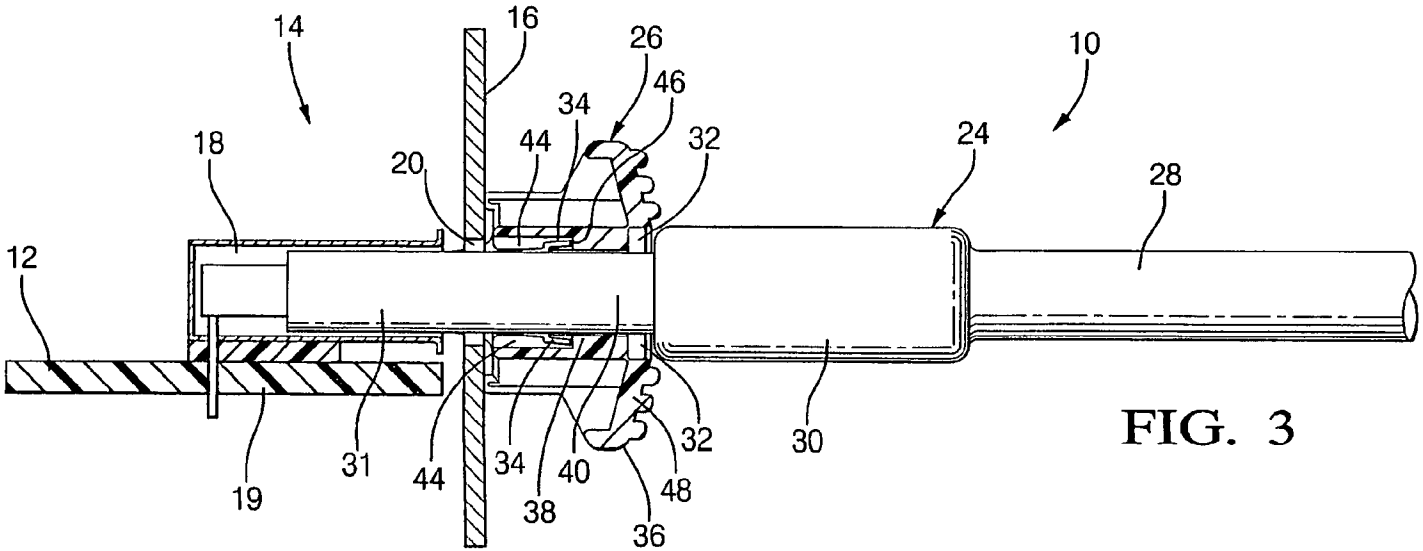
FIG. 3 is a longitudinal section of the electrical connection system shown in FIG. 1 taken substantially along the line 3—3 looking in the direction of the arrows.

The positive lock piece 26 preferably consists of a single, loose-piece, molded plastic part 36 having a rectangular collar 38 that fits onto the projecting portion 40 of female terminal 31 adjacent connector body 30. Collar 38 has three orientation slots 42 that extend a short distance inwardly from an outboard face and two longer slots 44 that extend a longer distance inwardly from an inboard face to provide retention shoulders 46. The positive lock piece 26 snap locks onto portion 40 of female terminal 31 with the slots 42 receiving the tabs 32 to properly orient the positive lock piece 26 and with the retention slots 44 receiving the retention fingers 34 to retain the positive lock piece 26 against the face of connector body 30 as best shown in FIG. 3.

The positive lock piece 26 includes a flange 48 that serves as a finger guard that is used to push the USB plug connector 24 into the USB socket connector 18 through access opening 20. The positive lock piece 26 further includes side walls 50 that support U-shaped lock arms 52 that extend forwardly in cantilever fashion from their respective forward ends.

Figure 4:
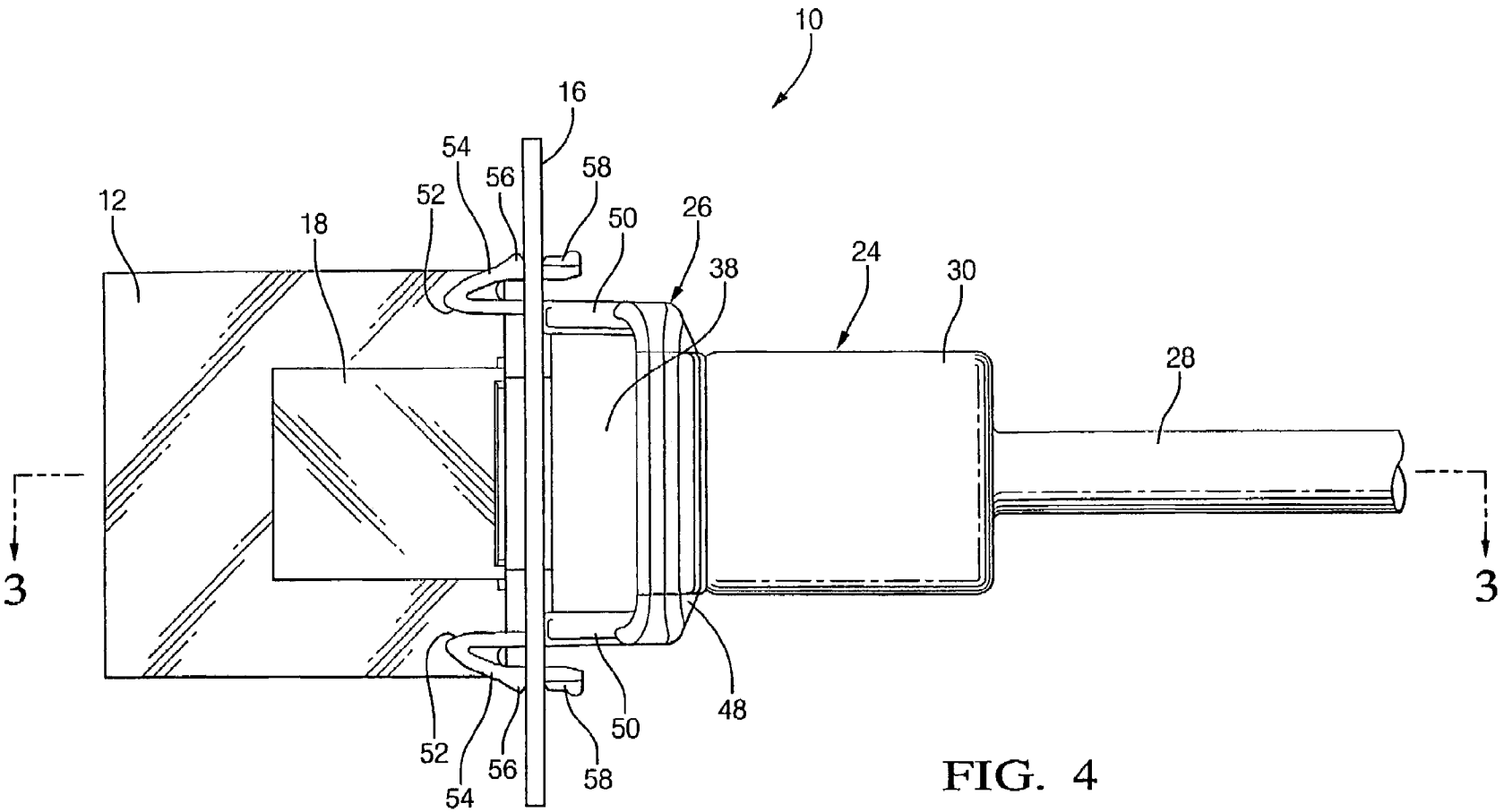
FIG. 4 is a top view of the electrical connection system shown in FIG. 1.

U-shaped lock arms 52 have outer portions 54 that include longitudinally spaced lock ramps 56 and 58 that are received in attachment openings 22 so as to engage inner and outer sides of face panel 16 and thus lock the positive lock piece 26 to the face panel 16 and retain the terminals properly mated as best shown in FIG. 4.

The positive lock piece 26 is assembled to the USB plug connector 24 manually or using automated equipment and is shipped to a vehicle assembly plant as part of an electrical wiring harness assembly. When the USB plug connector 24 is mated to the electronic device 12, the lock arms 52 are depressed as they are inserted into the housing 14 through the attachment openings 22 in face panel 16. Lock arms 52 preferably have staggered, multiple lock ramps 54, 56 so that the positive lock piece 26 always locks to the face panel 16 regardless of the relative postion of the USB socket connector 18 with respect to the face panel 16. Flange 48 with its parallel ribs 49 provides a convenient push surface and the lock arms 52 themselves provide lead-in features to aid the assembler in mating the USB plug connector 24 to the socket connector 18.

During vehicle operation, the positive lock piece 26 retains the USB connection system 10 in its fully mated postion. When disassembly is required, the dual lock arms 52 are manually depressed and the USB plug connector 24 is simply pulled out. The presence of the positive lock piece 26 makes it possible to use substantially standard USB connections in automotive environments by providing a positive locking feature.

While the positive lock piece 26 preferably snap locks onto the face panel 16 as described above with the attachment openings 22 serving as guides for the lock arms 52, other retention structures are possible. For instance, access opening 20 can be widened to include attachment openings 22 as part of the access opening or metal lock arms or tangs could be supported by side walls 50 in place of the integral U-shaped lock arms 52.

In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A positive lock piece for an electrical connector comprising:

a collar that is adapted to fit onto a terminal, the collar having at least one inner retention shoulder, a flange attached to the collar to serve as a finger guard, and lock arms for attaching the collar to a panel;

wherein the collar has an inboard face and a plurality of retention slots that extend a first distance inwardly from a top and a bottom of the inboard face; and wherein the collar has a plurality of orientation slots that exend inwardly from an outboard face.

2. The positive lock piece as defined in claim 1 wherein the positive lock piece consists of a single, one-piece, molded plastic component having a rectangular collar.

3. The positive lock piece as defined in claim 1 wherein the collar has at least one orientation slot that extends a short distance inwardly from the outboard face and at least one retention slot that extends a longer distance inwardly from the inboard face to provide the at least one inner retention shoulder.

4. A positive lock piece for an electrical connector comprising:

a collar that is adapted to fit onto a terminal, the collar having at least one inner retention shoulder, a flange attached to the collar to serve as a finger guard, and lock arms for attaching the collar to a panel;

wherein the positive lock piece consists of a single, one-piece, molded plastic component having a rectangular collar; and wherein the collar has a plurality of orientation slots that extend a short distance inwardly from an outboard face with at least one orientation slot in the top and in the bottom of the rectangular collar and retention slots that extend a longer distance inwardly from an inboard face of the top and bottom respectively including the at least one retention slot.

5. The positive lock piece as defined in claim 1 further comprising side walls that support the lock arms, the lock arms extending forwardly in cantilever fashion from their respective forward ends.

6. A positive lock piece for an electrical connector comprising:

a collar that is adapted to fit onto a terminal, the collar having at least one inner retention shoulder, a flange attached to the collar to serve as a finger guard, and lock arms for attaching the collar to a panel;

further comprising side walls that support the lock arms, the lock arms extending forwardly in cantilever fashion from their respective forward ends;

wherein the lock arms are U-shaped and have outer portions tat include longitudinally spaced look ramps.

7. An electrical connector assembly comprising an electrical connector having a separate lock piece attached to the electrical connector, the electrical connector comprising a terminal having one end disposed in a connector body, the lock piece having a collar that fits onto the terminal adjacent to the connector body, the collar having an inner retention shoulder for locking the separate lock piece onto the terminal, a flange attached to the collar to serve as a finger guard when the collar is attached to the terminal, and lock arms for attaching the lock piece to a face panel.

8. The electrical connector assembly as defined in claim 7 wherein the positive lock piece consists of a single, loose-piece, molded plastic component having a rectangular collar.

9. The electrical connector assembly as defined in claim 7 wherein the collar is rectangular and is fitted onto a rectangular portion of the terminal, the collar having at least one orientation slot that extends a short distance inwardly from an outboard face and at least one slot that extends a longer distance inwardly from an inboard face to provide the at least one inner retention shoulder.

10. The electrical connector assembly as defined in claim 9 wherein the collar has a plurality of orientation slots that exend a short distance inwardly from an outboard face with at least one orientation slat in the top and in the bottom of the rectangular collar respectively and retention slots that extend a longer distance inwardly from an inboard face of the top and bottom respectively.

11. The electrical connector assembly as defined in claim 7 wherein the positive lock piece further comprises side walls that support the lock arms, the lock arms extending forwardly in cantilever fashion from respective forward ends of the side wall.

12. The electrical connector assembly as defined in claim 11 wherein the lock arms are U-shaped and have outer portions that include longitudinally spaced lock ramps.

13. The electrical connector assembly as defined in claim 10 wherein the orientation slots of the collar receive upstanding tabs of the terminal to properly orient the positive lock piece with respect to the electrical connector and wherein the retention slots receive retention fingers of the terminal to retain the positive lock piece against a face of connector body.

14. The electrical connector assembly as defined in claim 7 wherein the connector body is a molded plastic connector body and the electrical connector is a USB connector having a rectangular female terminal that has an end embedded in a molded plastic connector body.

* * * * *